US005100292A

United States Patent [19]

Matula et al.

[11] Patent Number: 5,100,292

[45] Date of Patent: Mar. 31, 1992

[54] GAS TURBINE ENGINE BLADE

[75] Inventors: Lori E. Matula, Chicago, Ill.; Thomas A. Lindstedt, Cincinnati, Ohio

[73] Assignee: General Electric Company, Cincinnati, Ohio

[21] Appl. No.: 495,066

[22] Filed: Mar. 19, 1990

[51] Int. Cl.[5] ..... F01D 5/10

[52] U.S. Cl. ..... 416/220 R; 416/221; 416/248; 416/500

[58] Field of Search ..... 415/219 R, 220 R, 221, 415/248, 500

[56] References Cited

U.S. PATENT DOCUMENTS

| | | | |
|---|---|---|---|
| 639,608 | 12/1899 | Parsons | 416/196 R |
| 1,619,133 | 3/1927 | Kasley . | |
| 2,751,189 | 6/1956 | Ledwith | 416/217 |
| 2,846,184 | 8/1958 | Tournere | 416/221 |
| 2,994,507 | 8/1961 | Keller et al. | 416/221 |
| 3,567,337 | 3/1971 | Zerlauth et al. | 416/221 |
| 3,720,480 | 3/1973 | Plowman et al. | 416/220 |
| 3,752,600 | 8/1973 | Walsh et al. | 416/219 |
| 3,891,351 | 6/1975 | Norbut | 416/219 |
| 3,904,316 | 9/1975 | Clingman et al. | 416/218 |
| 4,022,545 | 5/1977 | Shank | 416/221 |
| 4,191,509 | 3/1980 | Leonardi | 416/219 R |
| 4,451,203 | 5/1984 | Langley | 416/215 |
| 4,451,205 | 5/1984 | Honda et al. | 416/219 R |
| 4,725,200 | 2/1988 | Welhoelter | 416/500 |
| 4,802,824 | 2/1989 | Gastebois et al. | 416/193 A |
| 4,820,126 | 4/1989 | Gavilan | 416/221 |
| 4,836,749 | 6/1989 | Gavilan | 416/221 |

FOREIGN PATENT DOCUMENTS

| | | | |
|---|---|---|---|
| 900222 | 12/1953 | Fed. Rep. of Germany . | |
| 1144925 | 10/1957 | France | 416/500 |
| 38603 | 3/1982 | Japan | 416/221 R |
| 418618 | 8/1974 | U.S.S.R. | 416/221 |
| 6640 | of 1908 | United Kingdom | 416/219 |
| 220623 | 8/1924 | United Kingdom . | |
| 801775 | 9/1958 | United Kingdom . | |

*Primary Examiner*—John T. Kwon

*Attorney, Agent, or Firm*—Jerome C. Squillaro

[57] ABSTRACT

A gas turbine engine blade is disclosed which includes a dovetail having retention lobes and fillets. Compression loads are provided in the dovetail for introducing compressive prestresses at the fillets for reducing tensile stresses at the fillets due to loads in the blade such as centrifugal tension loads. In an exemplary embodiment, the compression means comprises a cavity in the dovetail and an insert disposed therein in an interference fit for generating compressive stresses at the cavity and at the fillets.

12 Claims, 2 Drawing Sheets

GAS TURBINE ENGINE BLADE

BACKGROUND OF THE INVENTION

The present invention relates generally to gas turbine engine blades, and more specifically, to a blade having a dovetail including fillets and means for reducing total stress therein.

Conventional blades used in gas turbine engines include dovetails for retaining a blade in the outer circumference of a rotor disk. The dovetails may be symmetrical or asymmetrical and typically include circumferentially spaced lobes which fit into a complementary channel disposed in the perimeter of the turbine rotor disk to retain the blade. The dovetail lobes are connected to an airfoil portion of the blade through a shank and at the intersection thereof is typically formed a neck fillet. The fillet is an arcuate surface typically as a portion of a circle of a given radius and has values which are made as large as possible within physical constraints to reduce the concentration of stress thereat.

More specifically, a gas turbine rotor blade is subject to substantial centrifugal loading forces which generate tensile stresses in the blade. The centrifugal loads must be resisted by the dovetail secured to the rotor disk. The tensile stresses in the blade are also found in the dovetail and are necessarily concentrated at the fillets as is conventionally known. The fillets are therefore limiting factors in the design of the rotor blade since the stress at such fillets must be maintained at acceptable levels.

OBJECT OF THE INVENTION

Accordingly, it is one object of the present invention to provide a new and improved gas turbine engine rotor blade.

Another object of the present invention is to provide a turbine blade having a new and improved dovetail effective for accommodating higher centrifugal forces due to rotation of an airfoil portion of the blade from which the dovetail extends.

Another object of the present invention is to provide a blade dovetail including means for generating compressive stresses therein for offsetting centrifugal tensile stresses in the dovetail.

SUMMARY OF THE INVENTION

A blade for gas turbine engine includes an airfoil and a dovetail extending therefrom which includes at least one lobe for retaining the blade in an engine disk. The lobe defines a fillet subject to centrifugal tensile stress upon rotation of the blade. The invention includes compression means disposed in the dovetail for generating compressive stress in the fillet radius which is effective for reducing the total stress in the dovetail at the fillet.

BRIEF DESCRIPTION OF THE DRAWING

The invention in accordance with a preferred, exemplary embodiment, together with further objects and advantages thereof, is more particularly described in the following detailed description taken in conjunction with the accompanying drawing wherein.

DETAILED DESCRIPTION

Figure 1:
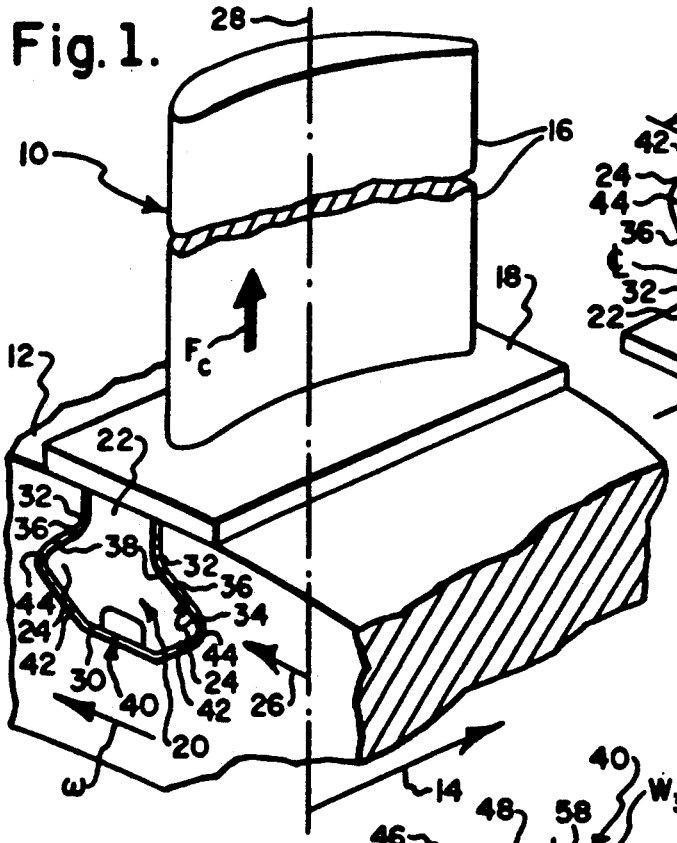
FIG. 1 is a perspective, partly sectional view of a gas turbine engine rotor disk including a rotor blade in accordance with the one embodiment of the invention.

Illustrated in FIG. 1 is a blade 10 in accordance with a preferred, exemplary embodiment of the present invention which is mounted in a gas turbine engine rotor disk 12 which is rotatable at a velocity $\omega$ about an axial centerline axis 14 of a gas turbine engine and the disk 12. Turbine disk 12 includes a plurality of circumferentially spaced ones of the blades 10, although only one blade 10 is illustrated in FIG. 1.

Figure 2:
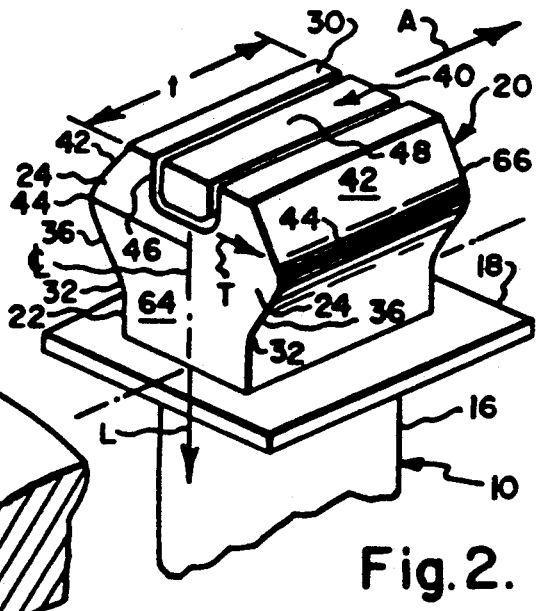
FIG. 2 is a perspective view of a dovetail in accordance with one embodiment of the present invention which is used to retain the gas turbine engine blade illustrated in FIG. 1 in the rotor disk.
Figure 3:
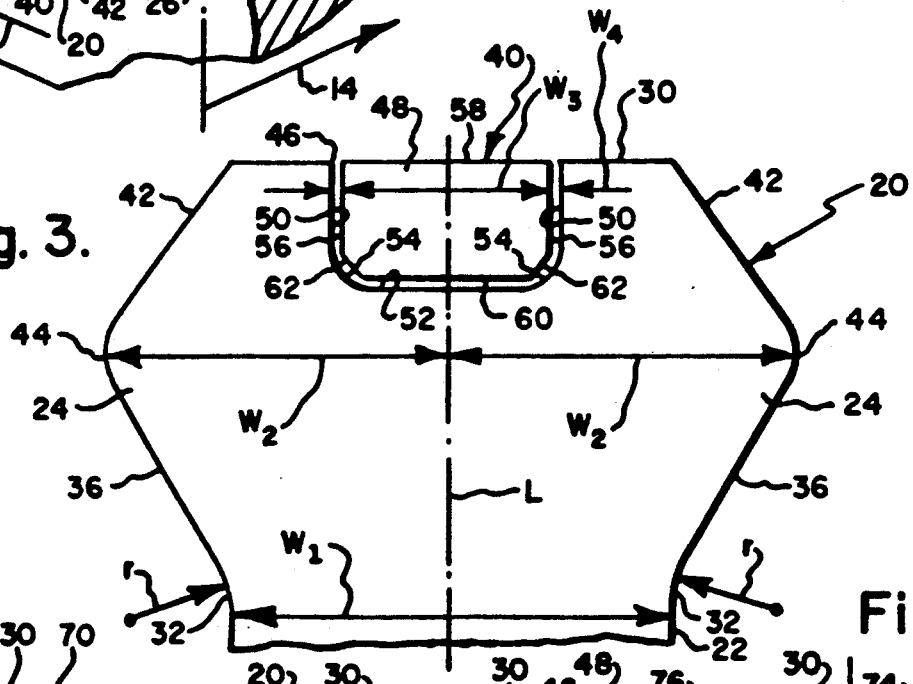
FIG. 3 is an enlarged end view of the dovetail illustrated in FIG. 2.

The blade 10 includes a conventional airfoil 16 over which flows turbine combustion gases for causing the rotor disk 12 to be rotated. Conventionally formed integrally to the airfoil 16 is an optional platform 18 which defines a portion of a radially inner flowpath. Extending integrally from and radially inwardly of the airfoil 16 and the optional platform 18 is a dovetail 20 in accordance with an exemplary, preferred embodiment of the present invention. As illustrated in FIGS. 1-3, the dovetail 20 includes a conventional shank 22 extending radially inwardly from the airfoil 16, and from the optional platform 18 which has a generally rectangular cross section. The dovetail 20 also includes a pair of conventional lobes 24 extending radially inwardly from the shank 22 and spaced from each other in a transverse or circumferential direction 26 which is generally disposed perpendicularly to both the axial axis 14 and a radial axis 28 which extends radially outwardly from the axial axis 14 and through the blade 10. The dovetail 10 further includes a generally flat base 30 at the radially inward end thereof which extends between the pair of lobes 24. Defined at the pair of lobes 24 where they intersect the shank 22 is a pair of corresponding conventional neck fillets 32 which are arcs having a radius r.

The dovetail 20 is therefore defined by the shank 22, the pair of lobes 24, and the base 30. The dovetail 20 is slideably inserted into and thereby disposed in a complementary shaped dovetail groove 34 extending into the outer circumference of the rotor disk 12 in the generally axial direction 14 as illustrated in FIG. 1.

The shank 22 conventionally has a width $W_1$ which is less than the maximum width $2W_2$ of the pair of lobes 24 and defines a necked-in portion at the neck fillets 32. Each of the lobes 24 includes a radially outwardly facing upper surface 36 which is positioned in contact with a pair of complementary radially inwardly facing lower surfaces 38 of the dovetail groove 34.

As used herein for simply convention purposes, "upper" and "lower" are relative to the dovetail 20 in the disk groove 34, and could be interchangeable.

When the rotor disk 12 is rotated in service, a centrifugal force $F_c$ is generated in the blade 10 and is channeled through the upper surfaces 36 of the dovetail 20 to the lower surfaces 38 of the dovetail groove 34 for retaining the blade 10 in the disk 12. The fillets 32 are conventionally known to experience a stress concentration of tensile stresses at the fillets 32.

In accordance with a preferred, exemplary embodiment of the present invention, compression means 40 are disposed in the dovetail 20 for generating compressive stress in the fillets 32 i.e., a compressive prestress. It is to be understood in the following description that the various tensile and compressive stresses are components of total stress and are conventionally algebraically additive. Since the compression means 40 is effective for generating a compressive stress in the fillets 32, the compressive stress when added to the tensile stresses thereat due to the centrifugal load $F_c$ results in an overall reduction in stress at the fillets 32. This provides for an improved dovetail 20 capable of accommodating either larger centrifugal loads $F_c$ for the same given dovetail geometry or, alternatively, the dovetail 20 may be correspondingly reduced in size to save weight and machining while still being able to accommodate the same amount of centrifugal force $F_c$.

The dovetail 20 is illustrated in more particularity in FIGS. 2 and 3. Each of the lobes 24 is generally triangular as defined by the upper surface 36 and a lower surface 42 which intersect with each other obliquely at a peak 44 which is disposed along a line of maximum thickness $W_2$ from a longitudinal axis L of the dovetail 20. The longitudinal axis L extends through the lobes 24 and the shank 22 generally parallel to the radial axis 28 of the rotor disk 12. In the exemplary embodiment illustrated, the lobes 24 and the fillets 32 are disposed symmetrically relative to the longitudinal axis L and the longitudinal axis L forms a centerline relative thereto. The lines of maximum width $W_2$ are disposed perpendicularly to the longitudinal axis L.

The compression means 40 in accordance with an exemplary embodiment of the present invention comprises a cavity or generally U-shaped channel 46 extending into the base 30 of the dovetail 20 and an insert or key 48 disposed in the cavity 46. The insert 48 is initially sized larger than the cavity 46 so that the insert 48 is disposed in the cavity 46 with an interference fit for generating compressive stresses at the fillets 32. In the embodiment illustrated, the cavity 46 has a substantially rectangular cross section and the insert 48 also has a complementary substantially rectangular cross section. Since the dovetail 22 is symmetrical about the longitudinal axis L, the cavity 46 is preferably disposed equidistantly between the pair of lobes 24 in the dovetail base 30. The compression means 40 thereby effects compressive stresses symmetrically in both the fillets 32.

In the embodiment illustrated, the channel 46 includes two transversely spaced flat side surfaces 50 disposed generally parallel to the longitudinal axis L and a bottom surface 52 joining the two channel side surfaces 50 at conventional blending fillets 54 comprising circular arcs which are effective for reducing stress at those intersections. The insert 48 has a generally rectangular cross section including two transversely spaced side surfaces 56 joined by a top surface 58 and a longitudinally spaced bottom surface 60. The bottom surface 60 joins the side surfaces 56 at chamfers 62 which allow a clearance for insertion of the insert 48 into the cavity 46. As used herein for simply conventional purposes, "top" and "bottom" are relative to the dovetail cavity 46 viewing the dovetail 20 "upside-down" as shown in FIGS. 2-7, and are interchangeable.

The insert 48 is sized so that the two insert side surfaces 56 are compressed in an interference fit between the two channel side surfaces 50. This is readily accomplished by having the width $W_3$ of the insert 48 between the insert side surfaces 56 predeterminately greater than a width $W_4$ of the channel 46 between the channel side surfaces 50 as shown in FIG. 3. In a preferred embodiment of the invention, the insert width $W_3$ may be up to about 0.004 inches greater than the width $W_4$ of the channel 46 for providing an effective amount of compressive stress in both the fillets 32. Of course, compressive stresses will also be generated at the two channel side surfaces 50, and tensile stresses will be generated at the blending fillets 54.

Figure 3A:
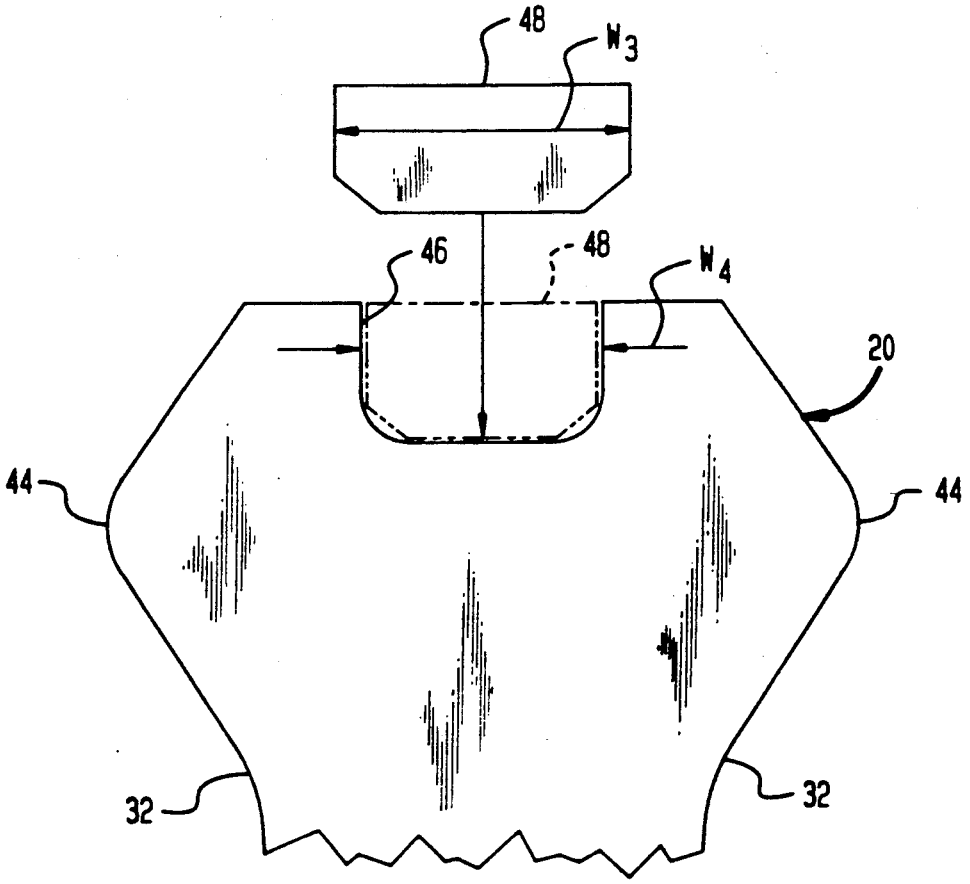
FIG. 3A is an exploded end view of the dovetail illustrated in FIG. 3 showing the insert removed from the dovetail.

The various inserts shown in FIGS. 1-7, including, for example, insert 48, are shown with gaps relative to the receiving cavities, such as channel 46. This is done solely for clarity of the Figures, it being understood that an interference fit is nevertheless intended as described herein. For example, FIG. 3A is an exploded view illustrating the insert 48 removed from the channel 46, and shows more clearly its width $W_3$ being initially greater than the width $W_4$ of the channel 46. THE insert 48 is also shown in phantom assembled into the channel 46 with an interference fit.

As illustrated more particularly in FIG. 2, the dovetail 20 has a thickness t extending from a forward end surface 64 of the dovetail 22 to an aft end surface 66 dovetail 20, which axial axis A is perpendicular to both the longitudinal axis L and the transverse axis T of the dovetail 20. The axial axis A is generally parallel to the axial centerline axis 14 of the rotor disk 12, the transverse axis T of the dovetail 20 is generally parallel to the transverse axis 26 of the disk 12, and the longitudinal axis L is generally parallel to the radial axis 28 of the rotor disk 12. The cavity 46 and the insert 48 are coextensive with each other and extend for the full thickness t of the dovetail 20 in the exemplary embodiment.

As illustrated in FIG. 3, the insert bottom surface 60 is spaced from the channel bottom surface 52 to provide an acceptable amount of clearance for inserting the insert 48 into the cavity 46. The compression of the insert 48 between the channel side surfaces 50 provides the compressive stresses in the fillets 32, and contact between the insert bottom surface 60 and the channel bottom surface 52 is not required.

The shape of both the insert 48 and the cavity 46 may be optimized depending upon particular design configurations of the dovetail 20 for introducing a maximum amount of compressive stress in both fillets 32. The upper limit of the amount of compressive stress that may be introduced into the fillets 32 is determined by the permissible local maximum tensile stress introduced around the cavity 46 near the blending fillets 54 due to the interference fit between the insert 48 and the cavity 46. Those local stresses can be designed to be up to about the yield stress of the particular material utilized. In one embodiment of the present invention, the interference fit of the insert 48 in the cavity 46 may be accomplished by heating the dovetail 20 for expanding the cavity 46 to allow the insert 48 to initially slide, without interference, into the cavity 46. The insert 48 may optionally be initially cooled to contract it before being placed into the heated cavity 46. The insert 48 is placed into the cavity 46 and the dovetail 20 is allowed to cool (and the insert 48 is allowed to warm) to a normal temperature which will then create an interference fit with the insert 48. If this method is chosen for inserting the insert 48 into the cavity 46, the maximum amount of compressive stress that may be introduced into the fillets 32 is limited by the ability of the material of the dovetail 20 to be expanded upon heating and the maximum tensile stress near the fillets 54 which are conventionally determined according to particular materials and geometries desired.

Figure 4:
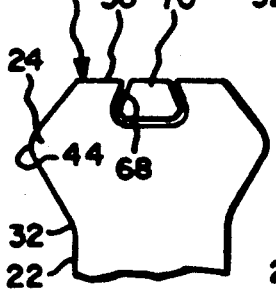
FIG. 4 is an end view of a dovetail in accordance with another embodiment of the present invention.

Illustrated in FIG. 4 is another embodiment of the present invention wherein the dovetail 20 includes a generally trapezoidal channel 68 and a complementarily shaped insert 70. The smaller dimensions of the insert 70 and channel 68 are disposed at the base 30 of the dovetail 20 and the larger dimensions of the insert 70 and channel 68 are disposed longitudinally inwardly therefrom. This arrangement provides a means for assuring that the insert 70 remains in the dovetail 20 during rotation of the blade 10 in the disk 12.

Figure 5:
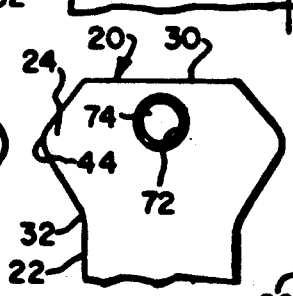
FIG. 5 is an end view of a dovetail in accordance with another embodiment of the present invention.

Illustrated in FIG. 5 is another embodiment of the present invention wherein the cavity 46 may take the form of a cylinder 72 disposed in the dovetail 20 just below the surface of the base 30. A complementary cylindrical insert 74 is disposed in an interference fit in the cylindrical cavity 72 which may be readily accomplished by having the insert 74 having an initial diameter greater than the diameter of the cylindrical cavity 72. The insert 74 may be simply press fit into the cylindrical cavity 72 for obtaining the interference fit along the entire outer surface of the insert 74. The cylindrical cavity 72 and the insert 74 are disposed equidistantly between the two lobes 24 in this embodiment since the lobes 24 are symmetrically spaced in the dovetail 20.

Figure 6:
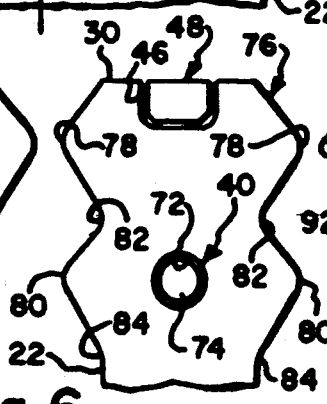
FIG. 6 is an end view of a dovetail in accordance with another embodiment of the present invention.

Illustrated in FIG. 6 is yet another embodiment of the present invention comprising a conventional fir tree type dovetail 76 having two longitudinally spaced pairs of lobes 78 and 80 and corresponding fillets 82 and 84. The compression means (46, 48) may be disposed in the base 30 of the dovetail 76 for providing compressive stress at the fillets 82 which may extend additionally to fillets 84. An additional compression means 40, such as the cylindrical cavity 72 and cylindrical insert 74 illustrated in FIG. 5, may also be introduced into the fir tree dovetail 76 illustrated in FIG. 6 equidistantly between the lower lobes 80 for providing compressive stresses in the fillets 84.

Figure 7:
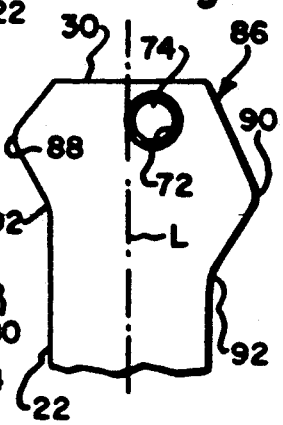
FIG. 7 is an end view of a dovetail in accordance with another embodiment of the present invention.

Illustrated in FIG. 7 is yet another embodiment of the present invention having a dovetail 86 including two lobes 88 and 90 disposes asymmetrically relative to longitudinal axis L. More specifically, although the lobes 88 and 90 are equidistantly spaced in the transverse direction perpendicularly to the longitudinal axis L they are spaced radially with respect to each other along the longitudinal axis L. Corresponding fillets 92 are formed at the juncture of the lobes 88 and 90 and the hank 22. In this embodiment the compression means 40 may comprise the cylindrical cavity 72 and the cylindrical insert 74 in interference fit therewith such as those disclosed in FIG. 5. The compression means 40 is predeterminately oriented relative to the longitudinal axis L and the base 30 for providing compressive stress in at least fillet 92 adjoining the upper lobe 88. The compression means 40 may be placed at a position which may be determined by trial and error for obtaining generally equal compressive stresses in both the fillets 92 adjoining both the lobes 88 and 90.

A conventional, two dimensional (2-D) photoelastic test was conducted on a thin, plastic, symmetric, 2 lobed dovetail model having a profile generally similar to the one shown in FIG. 3 under uniaxial tension along the longitudinal axis. Interference fits of the insert 48 in the channel 46 ranging from 0.001 to 0.004 inches were evaluated. The test results showed that the maximum stress at the fillets 32 was reduced up to about 34% for the geometry tested (with a 0.004 inch interference fit). By the conventionally known theory of superposition, the compressive prestress introduced at the fillets 32 by the interference fit of insert 48 in channel 46 when added to the applied tensile stress at the fillets 92, will reduce the maximum, total stress at the fillets 92.

While preferred and exemplary embodiments of the present invention have been described, other modifications will occur to those skilled in the art from the teachings herein. For example, the shape of the compression means 40 may be optimized depending upon particular dovetail geometry for minimizing local stresses around the compression means 40 while maximizing the compressive stresses at the fillets 32. Similarly, the placement of the compression means 40 in the dovetail 22 may also be optimized providing a maximum amount of compressive stress at the fillets 32.

In the exemplary embodiment illustrated in FIGS. 2 and 3, the dovetail 20 is symmetrical and is illustrated as being subject to solely a generally uniform centrifugal load $F_c$. However, during operation, the airfoil 16 of the blade 10 is also subject to aerodynamic loading and thermal loading which results in additional stresses in the blade 10 including the dovetail 20. These additional loads include for example bending stresses about the radial axis of the blade 10, or the longitudinal axis L of the dovetail 20. It is conventionally known that bending stresses include both compressive and tensile stresses.

Accordingly, depending upon the particular design application and the particular steady state stresses generated in the dovetail 20, the stresses at the fillets 32 may not be identical. Therefore, the compression means 40 may be predeterminedly spaced and configured relative to the lobes 24 and the fillets 32 to introduce compressive stress in the fillets 32 subject to tensile stresses generated by the blade 10. It is possible to introduce a different amount of compressive stress in one fillet 32 as compared to another fillet 32 to accommodate the difference in the amount of stresses nominally in the fillets 32 due to these other loads.

Accordingly, having described preferred embodiments of the present invention, what is claimed and desired to be secured by Letters Patent of the United States is the invention as defined and differentiated by the following claims:

1. A blade for mounting in a gas turbine engine disk comprising:

an airfoil;

a dovetail extending from said airfoil and including at least one lobe for retaining said blade in said engine disk, said lobe defining a fillet subject to centrifugal tensile stress upon rotation of said blade in said disk; and compression means disposed in said dovetail for generating compressive stress in said fillet, and including a cavity in said dovetail and an insert disposed in said cavity, said insert being initially sized larger than said cavity so that said insert is disposed in said cavity with an interference fit for generating compressive stresses at said cavity and at said fillet.

2. A blade according to claim 1 wherein said cavity has a substantially rectangular cross section and said insert has a substantially rectangular cross section.

3. A blade according to claim 2 wherein said dovetail is symmetric and includes a spaced pair of said lobes and fillets, said lobes being joined together at a base of said dovetail, and said cavity is disposed equidistantly between said pair of lobes in said dovetail base, and said compression means effects compressive stress in both said fillets.

4. A blade according to claim 1 wherein said cavity is cylindrical and said insert is cylindrical.

5. A blade according to claim 1 wherein:

said dovetail includes a shank joining said lobe to said airfoil at said fillet, a longitudinal axis extending through said lobe and said shank, an axial axis disposed perpendicularly to said longitudinal axis, a transverse axis disposed perpendicularly to both said longitudinal axis and said axial axis, said lobe having a peak disposed along a line of maximum width disposed perpendicularly to said longitudinal axis, and a base at said lobe; and said compression means cavity comprises a U-shaped channel extending into said base.

6. A blade according to claim 5 wherein:

said channel includes two transversely spaced flat side surfaces disposed generally parallel to said longitudinal axis and a bottom surface joining said two channel side surfaces;

said insert has a generally rectangular cross section including two transversely spaced side surfaces joined by a top surface and a longitudinally spaced bottom surface; and said insert is sized so that said two insert side surfaces are compressed in an interference fit between said two channel side surfaces.

7. A blade according to claim 6 wherein said dovetail has a thickness along said axial axis, and said cavity and said insert are coextensive and extend for said thickness of said dovetail.

8. A blade according to claim 7 wherein said insert bottom surface is spaced from said channel bottom surface.

9. A blade according to claim 6 further including two of said lobes and two of said fillets and wherein said base extends between said two lobes and said channel is disposed in said base equidistantly between said two lobes.

10. A blade according to claim 1 further including two of said lobes and two of said fillets disposed symmetrically relative to said longitudinal axis.

11. A blade according to claim 1 further including two of said lobes and two of said fillets disposed asymmetrically relative to said longitudinal axis.

12. A blade according to claim 11 wherein said compression means cavity is disposed between said two lobes so that compressive stress is generated in both said fillets.

* * * * *